United States Patent [19]

Edwards

[11] Patent Number: 4,485,967

[45] Date of Patent: Dec. 4, 1984

[54] MECHANICAL JOINT

[76] Inventor: Lawrence K. Edwards, 3507 Slade Run Dr., Falls Church, Va. 22042

[21] Appl. No.: 399,443

[22] Filed: Jul. 19, 1982

[51] Int. Cl.[3] ..... E01B 11/32

[52] U.S. Cl. ..... 238/226; 238/235; 238/243

[58] Field of Search ..... 238/221, 225, 227, 228, 238/233, 235, 236, 237, 238, 243, 226

[56] References Cited

U.S. PATENT DOCUMENTS

| | | | |
|---|---|---|---|
| 186,794 | 1/1877 | Brown et al. | 238/225 |
| 893,315 | 7/1908 | Ely | 238/225 |
| 906,796 | 12/1908 | Hawk | 238/235 |
| 949,415 | 2/1910 | Dailey | 238/235 |
| 1,080,124 | 12/1913 | Reed | 238/235 |
| 1,228,386 | 6/1917 | Ball | 238/235 |
| 1,248,342 | 11/1917 | Kranjec | 238/235 |
| 1,309,356 | 7/1919 | Englot | 238/235 |
| 1,410,364 | 3/1922 | Britcher | 238/235 |
| 1,530,706 | 3/1925 | Vandivier | 238/235 |
| 1,549,788 | 8/1925 | Murray | 238/235 |
| 1,644,235 | 10/1927 | Burkhalter et al. | 238/235 |
| 3,890,904 | 6/1975 | Edwards | 104/121 |

FOREIGN PATENT DOCUMENTS

| | | | |
|---|---|---|---|
| 38895 | 9/1909 | Austria | 238/225 |
| 1004199 | 1/1977 | Canada | 238/228 |

*Primary Examiner*—Robert B. Reeves
*Assistant Examiner*—David F. Hubbuch
*Attorney, Agent, or Firm*—Senniger, Powers, Leavitt and Roedel

[57] ABSTRACT

A connection for connecting a pair of rail members end to end, each rail member having a base, web, and a railhead. The connection comprises a tongue projecting endwise from the railhead of one rail member into a slot in the railhead of the other rail member, with the top of the tongue generally flush with the top of the railheads and the bottom of the tongue slidable on the other rail member for transmitting loads applied to the top of the railheads. The connection further comprises a longitudinally extending end projection on the other rail member slidable in a recess in the one rail member. The end projection is engageable with the one rail member for limiting the extent of the relative longitudinal movement and for transmitting tension force along the rail members. The connection transmits longitudinal, lateral and downward vertical loads on the rail members while allowing thermal expansion of the rail members, and presents a continuous load bearing surface along the top of the railheads. Also disclosed is a connector with an end projection having an L-shaped connecting member on the base portion of the other rail member and a lug in the base of the one rail member engageable with each other. A bar, lapping the webs of the rail members, is secured to the rail members.

5 Claims, 11 Drawing Figures

MECHANICAL JOINT

BACKGROUND OF THE INVENTION

This invention relates to mechanical joints, and more particularly to expansion joints for rails of a railway system.

The invention is especially concerned with expansion joints for the rails of a railway system such as shown in my U.S. Pat. No. 3,890,904, issued June 24, 1975, entitled Railway System, and may be regarded as involving an improvement over the expansion joint shown in FIGS. 18–24 of said patent.

SUMMARY OF THE INVENTION

Among the several objects of the invention may be noted the provision of an improved joint generally of the type shown in my said U.S. Pat. No. 3,890,904 for a railway system of the type shown in said patent, which joint may be useful for fixed elongate members other than rails; the provision of an improved, simplified and more rugged joint which includes an insert between the ends of successive rails acting as a ramp between the rails, avoiding shock loads even though alignment may not be perfect; the provision of such a joint adapted for direct transfer from the insert to the rails of downward, lateral and twisting loads on the insert while allowing longitudinal shift (e.g., thermal expansion and contraction) of the rails relative to the insert; the provision of such a joint providing even support for wheels passing over the joint as avoid "wheel click" and the associated high wheel loads; the provision of such a joint which enables passage of safety hooks which reach under the railheads; the provision of such a joint which, as used for the rails of a railway system such as shown in said U.S. Pat. No. 3,890,904, avoids columns supporting the railsupporting beams of the system from being pulled out of their normal vertical position; the provision of such a joint which is such as to enable an insert to be installed from above without disturbing the rails between the ends of which it is inserted; and the provision of such a joint which is such as to enable the insert to be made in one piece of the same rolled rail stock as the main rails and of longer length so as to constitute a longer ramp between rail ends; and the provision of such a joint which may be readily inspected.

In general, the invention involves a joint between adjacent ends of two elongate members (e.g., railway rails) which are fixed in position generally aligned with one another with a gap between their said adjacent ends, these members being subject to thermal expansion and contraction. The joint comprises a one-piece insert extending between said ends of the fixed elongate members in the gap therebetween generally in line with the fixed elongate members and adapted to bear loads in said gap, and interengaging means between the ends of the insert and said ends of the fixed elongate members constraining the insert against deflection relative to the fixed elongate members in a first plane extending longitudinally of the fixed elongate members and the insert, also against deflection relative to the fixed elongate members in a second plane at right angles to the first, and also against twisting deflection relative to the fixed elongate members, while permitting longitudinal movement of said ends of the fixed elongate members relative to the insert as may result from thermal expansion and contraction of the fixed elongate members.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENTS

Figure 1:
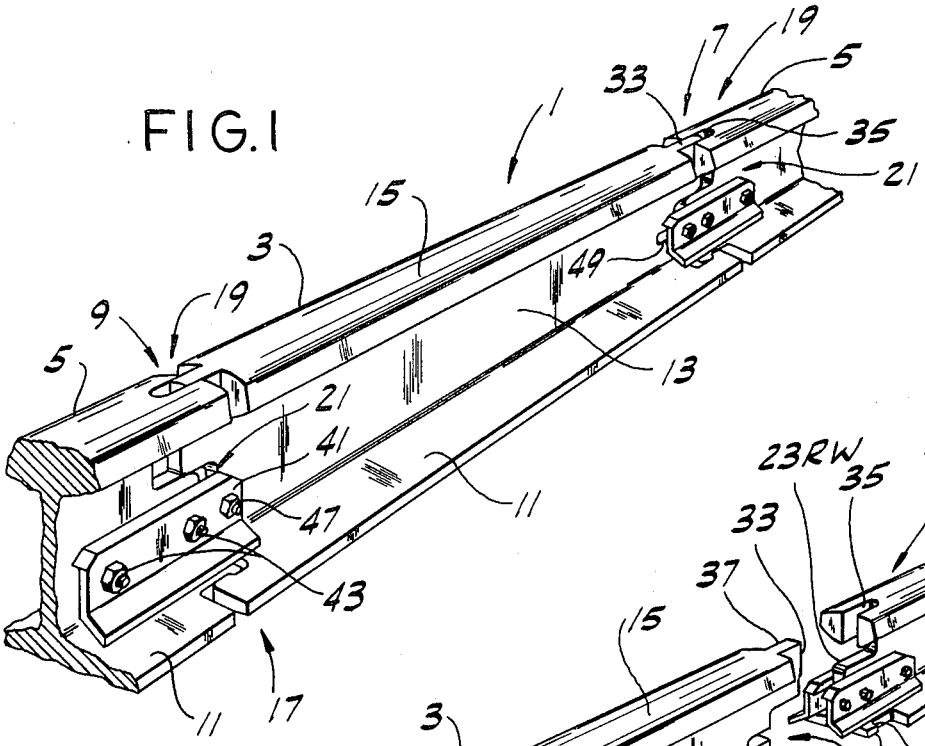
FIG. 1 is a perspective of a first embodiment of an end joint of this invention connecting the ends of two main rail members.
Figure 2:
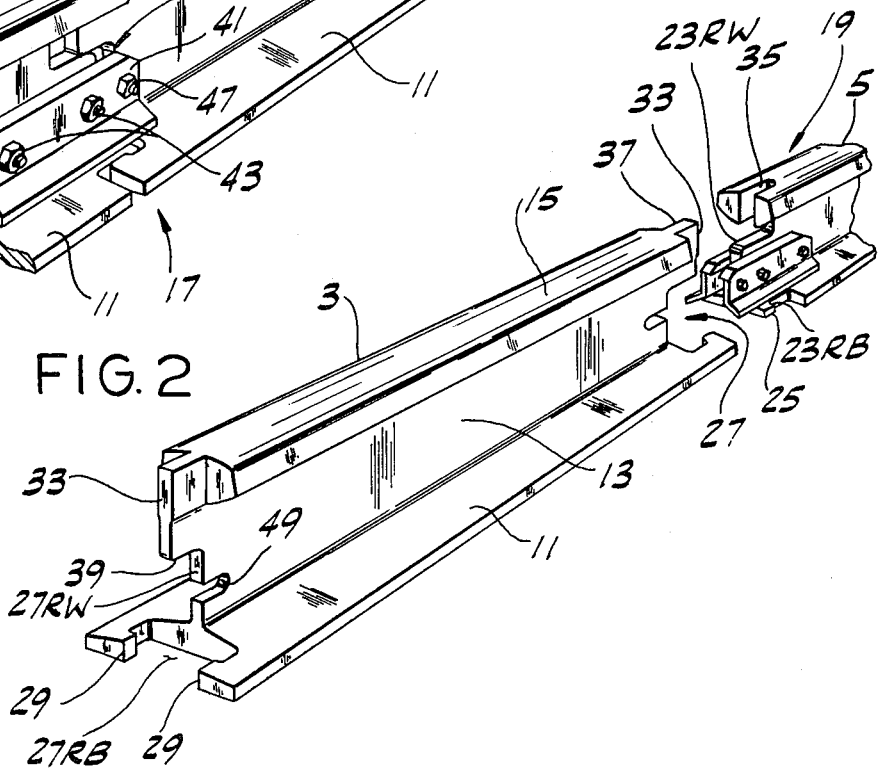
FIG. 2 is a perspective of an auxiliary rail member and a portion of a main rail member of the rail joint.

Referring to FIGS. 1–5 of the drawings, there is generally indicated at 1 in FIG. 1 a first embodiment of a rail joint of this invention comprising an auxiliary rail member or insert 3 extending between the ends of two main rail members 5 in a gap therebetween and connected at its ends to the main rail members by expansion connections generally indicated at 7 and 9. The auxiliary and main rail members are lengths of conventional railway rail, each having a base 11, a web 13 and a railhead 15, and are of the same size and shape in section. The auxiliary rail member, however, is relatively short in length (e.g., 27 inches long) in comparison to the main rail members which may be of a standard rail length (e.g., approximately 37 feet long) or of the length (i.e., approximately 20 meters) disclosed in my U.S. Pat. No. 3,890,904. The expansion connections 7, 9 at the ends of the auxiliary rail member 3 are generally symmetrical with respect to each other about the central transverse vertical plane through the rail member 3, so that a description of one end connection will suffice for both.

Figure 3:
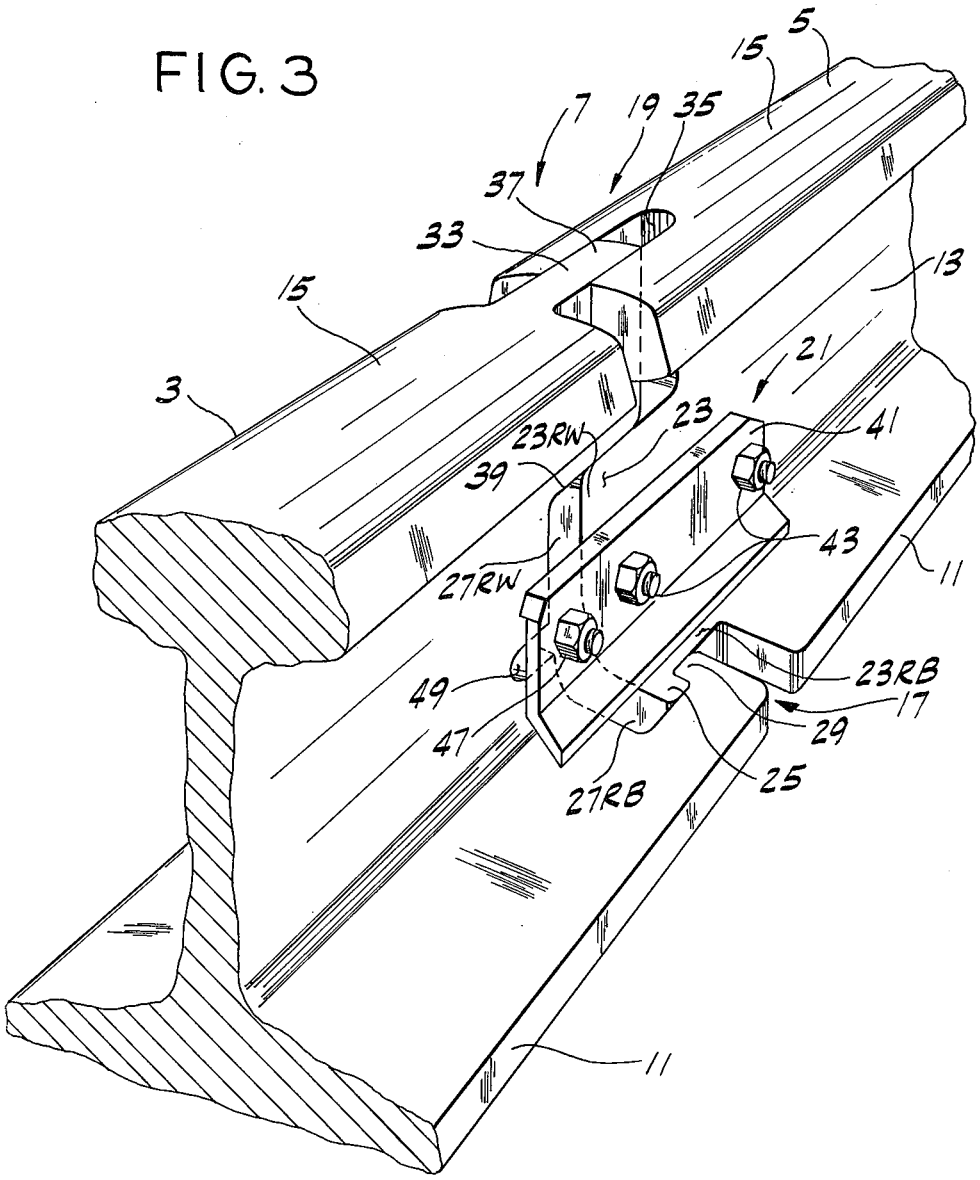
FIG. 3 is an enlarged fragmentary perspective of the rail joint showing a connection at one end thereof.
Figure 4:
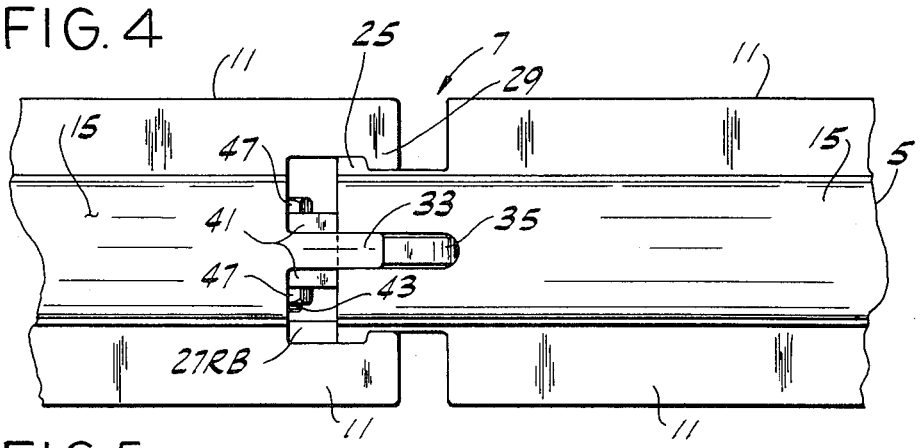
FIG. 4 is a top plan of the connection of FIG. 3.
Figure 5:
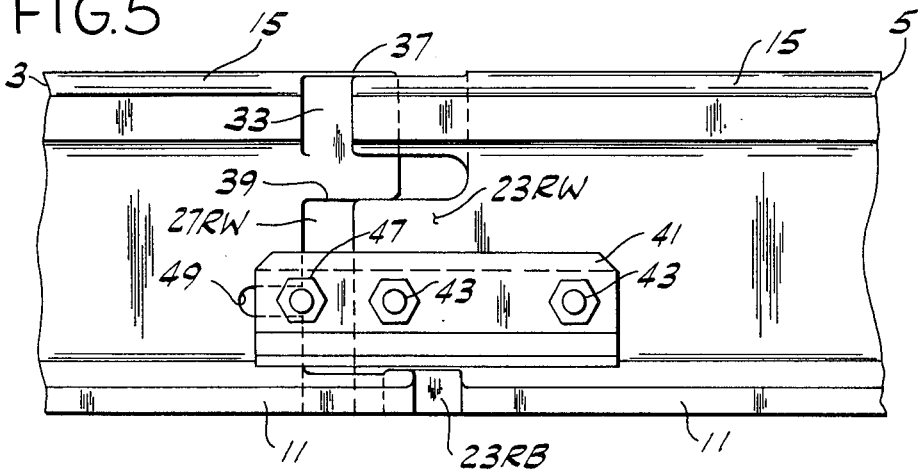
FIG. 5 is a side elevation of the connection of FIG. 3.

As best illustrated in FIGS. 3–5, the end connection 7 comprises means generally indicated at 17 interconnecting the bases 11 of the rail members, means generally indicated at 19 connecting the ends of the railheads 15, and means generally indicated at 21 connecting the webs 13 of the rail members. As described more fully hereinafter, these means function to enable the end connection 7 to transmit vertical, transverse and torsional (twisting) loads to the rail members, such as the loads applied to the rail members by railway cars traveling therealong, while allowing relative longitudinal movement of the rail members to accommodate thermal expansion thereof and to present a continuous load bearing surface along the top of the rail heads 15.

More particularly, the base connecting means 17 of each end connection 7 comprises a projection 23 at a respective end of the main rail member 5. This projection is of inverted-T shape in vertical section, having rail web and base portions designated 23RW and 23RB, respectively, constituted by extensions of the lower part of the web 13 and the base 11 of the main rail member. The base portion 23RB of the projection 23 is narrower than the base 11 of the main rail member and has a pair of lugs or ears 25 at its outer end projecting laterally outwardly from opposite sides of the base portion.

As indicated at 27, the auxiliary rail member or insert 3 is recessed at each of its ends for receiving the projections 23 of the two main rail members 5 being connected. Each recess 27 comprises a recess portion 27RW in the web 13 of the auxiliary rail member for receiving the web portion 23RW of a respective projection 23, and a recess portion 27RB in the base 11 of the auxiliary rail member for receiving the base portion 23RB of the projection 23. A pair of lugs or stops 29 at the outer end of the base 11 of the auxiliary rail member project laterally inwardly toward one another into the base portion 27RB of the recess 27 and are engageable by the ears or stops 25 on the base portion 23RB of the projection 23 for limiting relative longitudinal movement of the rails.

The projections 23 have a limited range of movement in the recesses 27 for allowing longitudinal movement of the rail members 5,5 with respect to one another. The stops 25 engage the stops 29 when the rail members tend to move apart a distance greater than this range for transmitting tension force along the rail members. Preferably, the range of movement is sufficient to accommodate not only longitudinal movement of the ends of the rail members due to thermal contraction thereof but also to provide tolerance between the rail members to facilitate the laying of railway track, including the laying of elevated track such as described in my U.S. Pat. No. 3,890,904. For example, in tracks in which the rail joint 1 is used between standard length main rail members, each end connection has sufficient range of movement (e.g., 0.9 inch) to accommodate not only a longitudinal movement (e.g., 0.44 inch) due to change in length of the rails over a 150° F. temperature range to prevent damage to the track and its supporting structure, such as the beams and support columns described in my U.S. Pat. No. 3,890,904, but also to provide longitudinal tolerance (e.g., 0.46 inch) facilitating the laying of the track.

The railhead connecting means 19 of end connection 7 comprises a tongue-and-slot connection between the main and auxiliary rail members 5, 3 extending generally in the central vertical longitudinal plane of the rail members. This connection comprises a tongue 33 projecting endwise from the railhead 15 of the auxiliary rail member into a slot 35 in the railhead and web of the main rail member. The tongue is of approximately the same width as the webs 13 of the rail members (and thus the web portion 23RW of the projection 23), and its top 37 is flush with the railheads to present a continuous load bearing surface along the top of the railheads. This continuous surface eliminates the "wheel click" which occurs with rail members connected by conventional expansion joints permitting a gap to exist between the ends of adjacent rail members. The bottom 39 of the tongue, which defines the top of the web portion 27RW of the recess 27 in the auxiliary rail member, bears on the top of the web portion 23RW of the projection 23 of the main rail member. This connection thus serves to transmit vertical and lateral loads on the railheads, while allowing relative longitudinal movement of the rail members. The stops 25 and 29 prevent movement of the tongue 33 out of bearing engagement with the web portion 23RW upon movement of the ends of the rail members 3, 5 away from each other. To enable uniform transmission of compressive force along the rail members at the end connection 7, the depth of the slot 35 is so related to the length of the tongue 33, and the depth of the recess 27 is so related to the length of the projection 23 that, when the rail members are longitudinally moved together into end-to-end engagement, they engage each other along the end edges of their railheads and along the outer end of the projection 23 of the rail member 5 and the inner edge of the recess 27 of the rail member 3.

The web connecting means 21 of each end connection 7 comprises a pair of splice bars 41 lapping the webs of the rail members on opposite sides thereof and bearing on the top of the bases of the rail members. As best illustrated in FIGS. 3 and 5, the splice bars 41 are detachably secured to the web of the main rail member 5 by a pair of conventional nut and bolt fasteners 43 and are held in sliding engagement with the web of the auxiliary rail member by clamping means comprising a fastener 47 extending through aligned holes in the splice bars and a slot 49 extending in the web of the auxiliary rail member longitudinally thereof. The fastener 47 is movable within the slot longitudinally thereof to accommodate relative longitudinal movement between the rail members due to thermal expansion and contraction of the rail member. In addition, the fastener is adapted to adjust the clamping force which the splice bars exert on the web of the auxiliary rail members thereby to inhibit relative longitudinal movement between the rail members, so that relative longitudinal movement of the rail members may occur upon thermal expansion of the rail members but not upon acceleration or deceleration of railway cars carried thereon.

Figure 6:
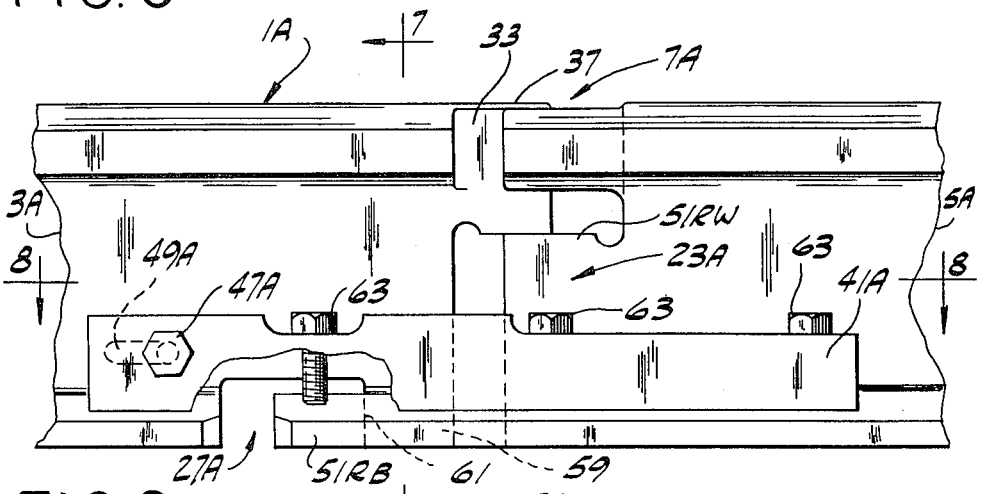
FIG. 6 is a side elevation of an end connection of a second embodiment of an expansion end joint of this invention.
Figure 8:
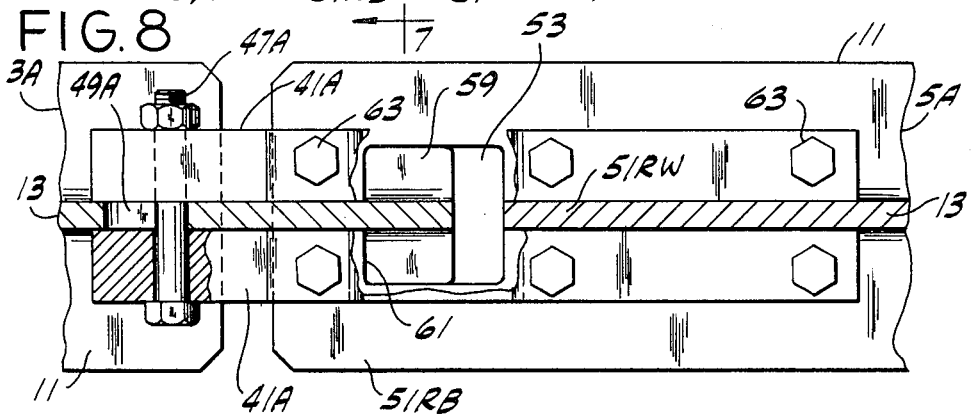
FIG. 8 is a longitudinal horizontal section on line 8—8 of FIG. 6.
Figure 7:
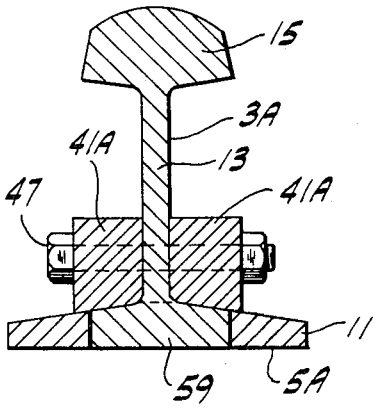
FIG. 7 is a transverse vertical section on line 7—7 of FIG. 6.

Referring to FIGS. 6–8, there is generally indicated at 7A an end connection of a second, and perhaps preferred, embodiment 1A of a rail joint of this invention which is generally similar to the first embodiment 1 except that the splice bars 41A are secured to the base of the main rail member 5A, and the end projection 23A comprises a rail base portion 51RB extending longitudinally beyond the end of the rail web portion 51RW, the rail base portion having a generally vertical opening 53 therein spaced from the sides and the ends thereof. The recess 27A in the auxiliary rail member or insert 3A is defined by an end portion receiving the web portion 51RW of the end projection 23A and further defined by a bottom portion extending laterally across the member and side portions forming a toe 59 on the base of the auxiliary rail member 3A. The toe 59 extends down into and is received in the opening 53 in the base portion 51RB of the end projection when the end projection 23A is received in the recess 27A as shown in FIGS. 6–8, and is engageable by the outer end wall 61 of the opening 53 for limiting relative longitudinal movement of the rail members and transmitting tension force along the rail members. As shown in FIG. 7, the splice bars 41A engage the bases 11 and webs 13 of the rail members and are of greater width than the splice bars 41 so as to accommodate generally vertical holes receiving screws 63 threaded in holes in the base 11 of the main rail member 5A.

Figure 9:
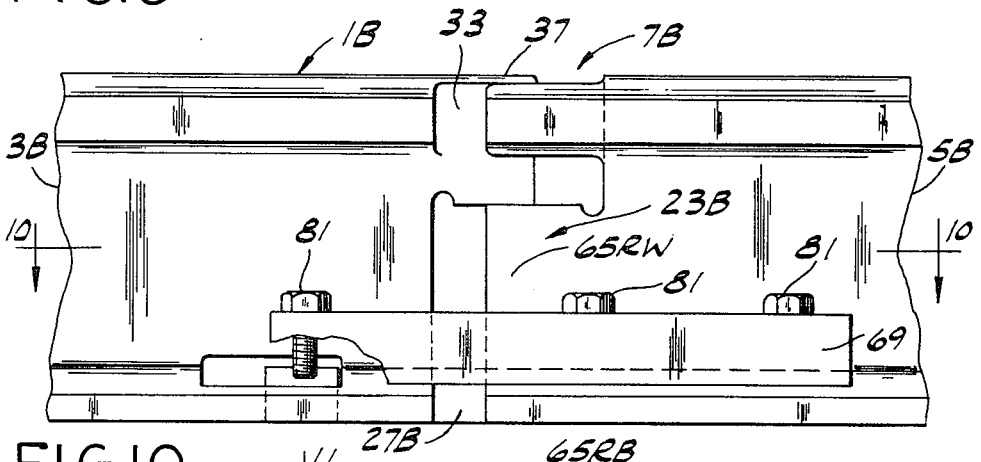
FIG. 9 is a side elevation of an end connection of a third embodiment of the expansion end joint of this invention.
Figure 10:
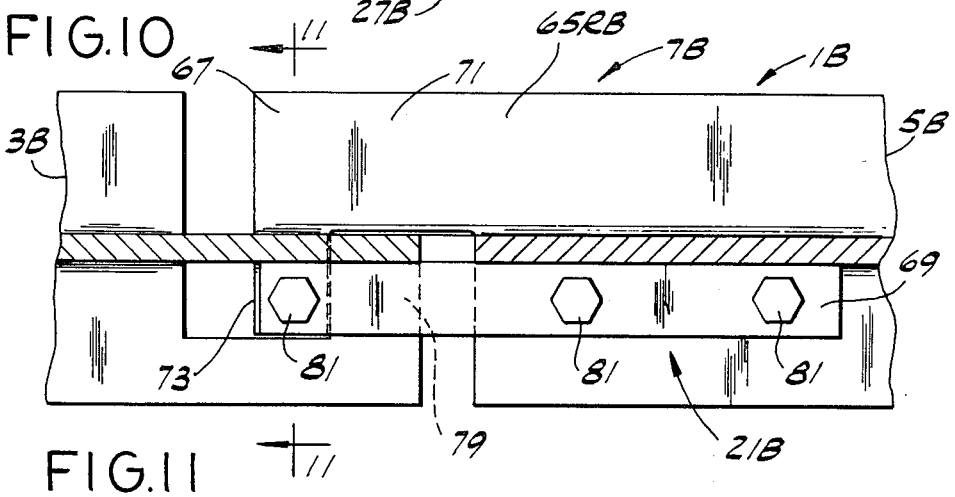
FIG. 10 is a longitudinal horizontal section on line 10—10 of FIG. 9.
Figure 11:
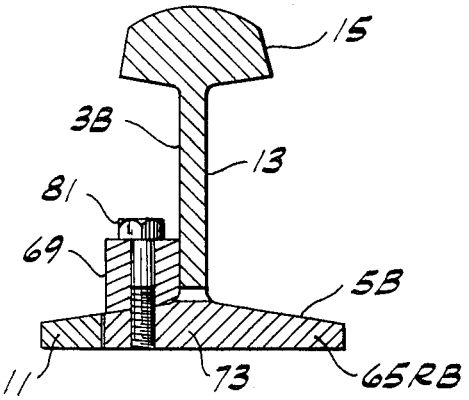
FIG. 11 is a transverse vertical section on line 11—11 of FIG. 10.

Referring to FIGS. 9–11, there is generally indicated at 7B an end connection of a third embodiment 1B of a rail joint of this invention which is generally similar to the first embodiment 1 except that the end projection 23B comprises a rail base portion 65RB having an L-shaped connecting member 67 thereon and means 21B corresponding to 21 comprises a single bar 69 lapping the webs 13 of the rail members 3B, 5B. One leg 71 of the L-shaped connecting member 67 extends longitudinally with respect to the main rail member 5B along one side of the base thereof. The other leg 73 extends transversely with respect to the main rail member toward but stops short of the other side of the main rail member. The recess 27B in the auxiliary rail member or insert 5B is defined by a portion in the web of the member for receiving the web portion 65RW of said end projection, and further defined by a portion in the base 11 of the member having a first reach extending laterally across the member at the end thereof, a second reach extending longitudinally along the member at one side thereof and a third reach extending laterally from said one side of the member toward but stopping short of the other side of the member, thereby forming a laterally extending lug or finger 79 on the base. The leg 73 of the connecting member 67 is engageable with the lug 79 for limiting the extent of relative longitudinal movement of the rail members and for transmitting tension force along the rail members. As shown in FIGS. 9–11, the bar 69 engages the webs and bases of the rail members 3B, 5B and is secured to the leg 73 of the L-shaped connecting member 67 and the base 11 of the main rail member 5B by screws 81 extending through generally vertical holes in the bar and threaded in holes in the base 11 of the main rail member 5B and the leg 73. The bar 69 is free of attachment to the auxiliary rail member 3B, thus enabling relative longitudinal movement of the rail members. Rail anchors (not shown) mount the rail members 3B, 5B on a support structure (not shown), such as the beam disclosed in my U.S. Pat. No. 3,890,904, for movement of the rail members along their longitudinal axes due to thermal expansion and contraction of the rail members, but restrict movement of the rail members under loads due to railway car acceleration and braking.

In each of the three disclosed embodiments, the structure involves a mechanical joint between the adjacent ends of two elongate members which are fixed in position generally aligned with one another with a gap between these ends. In each embodiment, the fixed elongate members are the main rails (5, 5A, 5B), and the insert is the auxiliary rail (3, 3A, 3B). The insert is a onepiece insert extending between the ends of the fixed elongate members and is adapted to bear loads in the gap. In each embodiment, interengaging means is provided between the ends of the insert and the ends of the fixed elongate members constraining the insert against deflection relative to the fixed elongate members in a first plane (e.g., a vertical plane) extending longitudinally of the fixed elongate members and the insert, also against deflection relative to the fixed elongate members in a second plane at right angles to the first, and also against twisting deflection relative to the fixed elongate members, while permitting longitudinal movement of said ends of the fixed elongate members relative to the insert as may result from thermal expansion and contraction of the fixed elongate members. In each embodiment, the constraining means comprises first and second projections extending endwise from the ends of the insert and second projections at the ends of the fixed elongate members, the first projections being in longitudinal sliding engagement with the second projections and constraining the insert against deflection relative to the fixed elongate members in said first plane. In the first embodiment, these are the bottom portion of 33 and the top portion of 23RW, which are in horizontal sliding engagement at 39. In the second embodiment, they're the bottom portion of 33 and the top portion of 51RW. In the third, they're the bottom portion of 33 and the top portion of 65RW. In each embodiment the constraining means comprises longitudinally extending tongue and slot interconnections at said ends in said first plane constraining the insert against deflection relative to the fixed elongate members in said second plane, the tongues of said interconnections being longitudinally slidable in the slots. In each instance, this comprises the upper portion of 33 and the slot in which it is slidable. In each embodiment, the constraining means also comprises longitudinally extending slidably interengageable interconnections at said ends constraining the insert against twisting deflection relative to the fixed elongate members. In the first embodiment, this involves 23RB slidable in 27RB. In the second, it involves toe 59 slidable in opening 53. In the third, it involves 73, 79. In each embodiment, the constraining means further includes means for limiting the longitudinal movement of said ends of the fixed elongate members relative to the insert. In the first embodiment, this involves stops 25, 29. In the second, it involves 61 and the end of the toe 59. In the third, it involves 73, 79.

Each of the three embodiments 1–1B of the improved rail joint of this invention transmits torsional, longitudinal, lateral and vertical forces on the main rail members including upwardly directed forces such as may be applied to the rails by a railway car having safety hooks such as shown in my U.S. Pat. No. 3,890,904, while allowing thermal expansion of the rail members In addition, the joint presents a continuous load bearing surface along the top of the railheads of the rail members. In each instance, the auxiliary rail member or insert (3, 3A, 3B) is adapted to be installed from above, thus simplifying laying the track.

While the joint of this invention has been shown and described as connecting rail members, it is contemplated that the joint may be used to connect other elongate elements, such as I-beam structural members. Moreover, it will be understood that the joint may also be used to connect rail members, such as those shown in my U.S. Pat. No. 3,890,904, supported with their webs other than vertical. Further, while the projection 23–23B is herein illustrated as an integral part of the main rail member 5–5B and tongue 33 as an integral part of the auxiliary rail member 3–3B, it is contemplated that this arrangement could be reversed. It will also be understood that the bars (41, 41A and 69) could be immovably secured to the auxiliary rail member and movable relative to the main rail members.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A connection for connecting a pair of rail members, such as railway rail members, end to end, each rail member having a base, web, and a railhead, said connection comprising means connecting the bases of the rail members for allowing relative longitudinal movement of the rail members within a limited range of movement and for transmitting tension force along the rail members when they tend to move apart a distance greater than said range of movement, means connecting the ends of the railheads of the rail members comprising a tongue projecting endwise from the railhead of one rail member into a slot in the railhead of the other rail member, with the top of the tongue generally flush with the top of the railheads and the bottom of the tongue slidable on said other rail member for transmitting loads applied to the top of the railheads, said base connecting means comprising a longitudinally extending end projection on said other rail member slidable in a recess in said one rail member, said end projection having base and web portions constituted by extensions of the base and the lower part of the web of said other rail member, said end projection further having means engageable with said one rail member for limiting the extent of said relative longitudinal movement and for transmitting tension force along the rail members, the bottom of said tongue being slidable on the top of said end projection, and means for transmitting lateral loads on the rail members while allowing relative longitudinal movement of the rail members, the connection thereby transmitting longitudinal, lateral and downward vertical loads on the rail members while allowing thermal expansion of the rail members, and presenting a continuous load bearing surface along the top of the railheads.

2. A connection for connecting a pair of rail members, such as railway rail members, end to end, each rail member having a base, a web, and a railhead, said connection comprising means connecting the bases of the rail members for allowing relative longitudinal movement of the rail members within a limited range of movement and for transmitting tension force along the rail members when they tend to move apart a distance greater than said range of movement, means connecting the ends of the railheads of the rail members comprising a tongue projecting endwise from the railhead of one rail member into a slot in the railhead of the other rail member, with the top of the tongue generally flush with the top of the railheads and the bottom of the tongue slidable on said other rail member for transmitting loads applied to the top of the railheads, said base connecting means comprising a longitudinally extending end projection on said other rail member slidable in a recess in said one rail member, said end projection having base and web portions constituted by extensions of the base and the lower part of the web of said other rail member, said end projection further having means engageable with said one rail member for limiting the extent of said relative longitudinal movement and for transmitting tension force along the rail members, the base portion of said end projection extending longitudinally beyond the end of the web portion, and having a generally vertical opening therein spaced from the sides and the ends of the base portion, the recess in said one rail member defined by an end portion in the web of said one rail member receiving the web portion of said end portion, and further defined by a bottom portion in the base of said one rail member extending laterally across said one rail member and by side portions forming a toe on the base of said one rail member adapted to extend down into said opening in the base portion of the end projection when the end projection is in the recess in said one rail member, and means for transmitting lateral loads on the rail members while allowing relative longitudinal movement of the rail members, the connection thereby transmitting longitudinal, lateral and downward vertical loads on the rail members while allowing thermal expansion of the rail members, and presenting a continuous load bearing surface along the top of the railheads.

3. A connection as set forth in claim 2 wherein the outer wall of said opening in the base portion of the end projection is engageable with said toe and constitutes said limiting means.

4. An end connection for connecting a pair of rail members, such as railway rail members, end to end, each rail member having a base, a web, and a railhead, said connection comprising means connecting the bases of the rail members for allowing relative longitudinal movement of the rail members within a limited range of movement and for transmitting tension force along the rail members when they tend to move apart a distance greater than said range of movement, means connecting the ends of the railheads of the rail members comprising a tongue projecting endwise from the railhead of one rail member into a slot in the railhead of the other rail member, with the top of the tongue generally flush with the top of the railheads and the bottom of the tongue slidable on said other rail member for transmitting loads applied to the top of the railheads, said base connecting means comprising longitudinally extending end projection on said other rail member slidable in a recess in said one rail member, said end projection having base and web portions constituted by extensions of the base and the lower part of the web of said other rail member, said end projection further having means engageable with said one rail member for limiting the extent of said relative longitudinal movement and for transmitting tension force along the rail members, the end projection having an L-shaped connecting member on its base portion, one leg of the L-shaped connecting member extending longitudinally with respect to said other rail member generally along one side thereof, the other leg of the L-shaped connecting member extending generally laterally with respect to said other rail member and constituting said limiting means, said recess in said one rail member defined by a portion in said one rail web of the member for receiving the web portion of said end projection and further defined by a portion in the base of said one rail member having a first reach extending laterally across said one rail member at the end thereof, a second reach extending longitudinally along said one rail member at one side thereof, and a third reach extending laterally from said one side of said one rail member toward but stopping short of the other side of said one rail member thereby forming a laterally extending lug in the base engageable by said other leg of the L-shaped connecting member, and means for transmitting lateral loads on the rail members while allowing relative longitudinal movement of the rail members, the connection thereby transmitting longitudinal, lateral and downward vertical loads on the rail members while allowing thermal expansion of the rail members, and presenting a continuous load bearing surface along the top of the railheads, said means for transmitting lateral loads comprises a bar lapping the webs of the rail members and secured to said other leg of the L-shaped connecting member and to said other rail member adjacent the end portion thereof.

5. An end connection as set forth in claim 4 wherein said bar engages the bases and webs of said rail members.

* * * * *